US009695775B2

(12) United States Patent
Darscheidt et al.

(10) Patent No.: US 9,695,775 B2
(45) Date of Patent: Jul. 4, 2017

(54) INTERNAL COMBUSTION ENGINE HAVING A SPACER SLEEVE WITH A CENTERING DEVICE

(71) Applicant: DEUTZ Aktiengesellschaft, Cologne (DE)

(72) Inventors: Jürgen Darscheidt, Cologne (DE); Wilhelm Feuser, Bornheim (DE); Harald Reuter, Cologne (DE); Robert Schumacher, Bergisch-Gladbach (DE)

(73) Assignee: DEUTZ Aktiengesellschaft, Cologne (DE)

( * ) Notice: Subject to any disclaimer, the term of this patent is extended or adjusted under 35 U.S.C. 154(b) by 78 days.

(21) Appl. No.: 14/410,540

(22) PCT Filed: Jun. 14, 2013

(86) PCT No.: PCT/EP2013/001764
§ 371 (c)(1),
(2) Date: Dec. 22, 2014

(87) PCT Pub. No.: WO2014/000866
PCT Pub. Date: Jan. 3, 2014

(65) Prior Publication Data

US 2015/0337754 A1 Nov. 26, 2015

(30) Foreign Application Priority Data

Jun. 26, 2012 (DE) ..... 10 2012 012 703

(51) Int. Cl.
*F02F 1/42* (2006.01)
*F01N 13/10* (2010.01)
*F01N 13/18* (2010.01)

(52) U.S. Cl.
CPC ..... *F02F 1/4264* (2013.01); *F01N 13/10* (2013.01); *F01N 13/1805* (2013.01); *F01N 13/1811* (2013.01); *Y10T 29/49964* (2015.01)

(58) Field of Classification Search
CPC ..... F02F 3/0023; F01N 13/1805; F01N 13/1811; F01N 2450/24; F01N 13/1838; F16L 19/00; F16L 41/086
(Continued)

(56) References Cited

U.S. PATENT DOCUMENTS 2,277,536 A * 3/1942 Williams ..... B28B 7/36 60/511
5,020,204 A 6/1991 Desair
(Continued)

FOREIGN PATENT DOCUMENTS

DE 37 42 036 A1 6/1989
DE 198 27 276 A1 4/1999
(Continued)

OTHER PUBLICATIONS

Machine translation of DE1987276, 1999, see "DE1987276_MachineTranslation.pdf".*
(Continued)

*Primary Examiner* — Stephen K Cronin
*Assistant Examiner* — Long T Tran
(74) *Attorney, Agent, or Firm* — Davidson, Davidson & Kappel, LLC

(57) ABSTRACT

An internal combustion engine is provided. The internal combustion engine includes at least one cylinder head and at least one exhaust pipe having at least one flange, whereby the flange has at least two flange fastening holes that have at least two fastening screws for fastening the exhaust pipe to the cylinder head of the internal combustion engine, whereby the exhaust pipe can be arranged so as to be
(Continued)

connected to the cylinder head by means of the fastening screws in such a way that it can be dismantled, whereby at least one centering device is provided essentially in the area of the flange holes.

10 Claims, 7 Drawing Sheets

(58) Field of Classification Search
USPC ..... 123/193.5, 193.1; 285/405, 410, 412, 285/417
See application file for complete search history.

(56) References Cited

U.S. PATENT DOCUMENTS

| | | | | |
|---|---|---|---|---|
| 6,327,854 | B1 | 12/2001 | Bonny et al. | |
| 6,454,318 | B1 | 9/2002 | Nozaki et al. | |
| 6,974,137 | B2 * | 12/2005 | Beutter | F01N 13/10 277/594 |
| 7,185,490 | B2 * | 3/2007 | Smatloch | F01N 13/10 277/591 |
| 8,230,680 | B2 * | 7/2012 | Riekers | F01N 13/10 60/321 |
| 2004/0113370 | A1 * | 6/2004 | Beutter | F01N 13/10 277/591 |
| 2005/0155561 | A1 * | 7/2005 | Atkins | F01P 3/02 123/41.81 |
| 2010/0025984 | A1 * | 2/2010 | Kullen | F01N 13/10 285/189 |
| 2010/0078933 | A1 * | 4/2010 | Stemmer | F01N 13/10 285/300 |

FOREIGN PATENT DOCUMENTS

| | | | |
|---|---|---|---|
| DE | 199 16 943 | A1 | 5/2000 |
| DE | 199 20 822 | A1 | 11/2000 |
| DE | 199 60 619 | A1 | 7/2001 |
| DE | 101 41 944 | A1 | 4/2003 |
| DE | 103 06 790 | | 9/2004 |
| JP | 2004 270 550 | A | 9/2004 |
| JP | 2006 274 988 | A | 10/2006 |
| JP | 2010 116 826 | A | 5/2010 |

OTHER PUBLICATIONS

International Search Report for corresponding International Application PCT/EP2013/001764.

* cited by examiner

| Nr. | Var. 8 | Var. 9 |
|---|---|---|
| 1 | 2,15 | 1,85 |
| 2 | 1,94 | 1,39 |
| 3 | 0,71 | 0,62 |

| Nr. | Var. 8 | Var. 9 |
|---|---|---|
| 1 | 0,76 | 0,58 |
| 2 | 0,87 | 0,51 |
| 3 | 0,36 | 0,32 |

| Nr. | Var. 8 | Var. 9 |
|---|---|---|
| 1 | 1237 | 1100 |
| 2 | 1009 | 817 |
| 3 | 1018 | 858 |

| Nr. | Var. 8 | Var. 9 |
|---|---|---|
| 1 | 1237 | 874 |
| 2 | 1009 | 762 |

INTERNAL COMBUSTION ENGINE HAVING A SPACER SLEEVE WITH A CENTERING DEVICE

The invention relates to a spacer sleeve having a screw centering device for fastening exhaust-gas lines to internal combustion engines. The spacer sleeves serve to enlarge the tensioning length of the screwed connection.

BACKGROUND

Prior-art configurations such as those disclosed, for example, in German patent application DE 10306790 A1 have a cylindrical through hole. The drawback of the cylindrical through hole is that the screw is usually inserted so tightly through the spacer sleeve that the freedom of movement of the screw is so severely limited that leakage can occur when the screwed connection is loosened.

SUMMARY OF THE INVENTION

An object of the present invention is to avoid the above-mentioned disadvantages and to create an internal combustion engine that has secure screwed connections.

An internal combustion engine is provided comprising at least one cylinder head and at least one exhaust pipe having at least one flange, whereby the flange has at least two flange fastening holes that have at least two fastening screws for fastening the exhaust pipe to the cylinder head of the internal combustion engine, whereby the exhaust pipe can be arranged so as to be connected to the cylinder head by means of the fastening screws in such a way that it can be dismantled, whereby at least one centering device is provided essentially in the area of the flange holes.

An advantage of this is that, since the spacer sleeve is supported in the center, no loss of pre-tensioning or loosening of the screwed connection can occur as a result of the greater freedom of movement of the screw. The embodiment according to the invention has a screw centering device, thus ensuring freedom of movement for the screw in the head area and in the area where the spacer sleeve is in contact with the exhaust pipe. Thanks to this centering, the concentric orientation between the screw and the spacer sleeve is still ensured, in spite of the greater freedom of movement.

BRIEF SUMMARY OF THE DRAWINGS

The invention will be explained in greater detail on the basis of several embodiments making reference to the drawings, which show the following.

DETAILED DESCRIPTION

Figure 1:
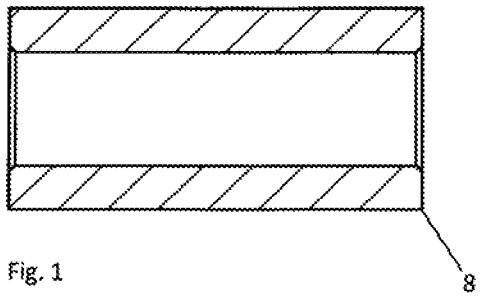
FIG. 1 a section through a spacer sleeve according to the state of the art.

FIG. 1 shows a spacer sleeve 8 of the type disclosed in the state of the art, for instance, German patent application DE 10306790 A1.

Figure 2:
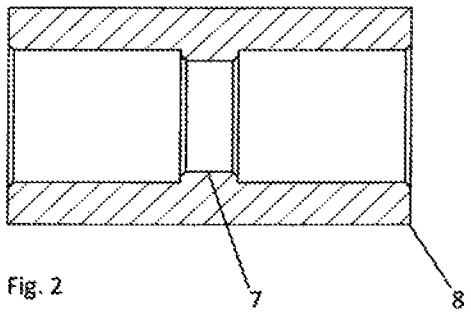
FIG. 2 a section through a spacer sleeve having a centering device in accordance with an embodiment of the present invention.

FIG. 2 shows a section through a spacer sleeve 8 having a centering device 7.

Figure 3:
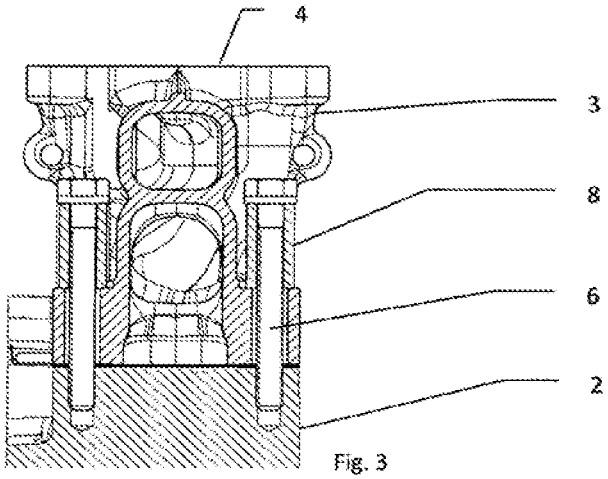
FIG. 3 an embodiment according to the state of the art.

FIG. 3 discloses an installed embodiment according to the state of the art. The exhaust pipe 3 having a flange 4 is screwed to the cylinder head 2 via the spacer sleeve 8 by means of the fastening screw 6.

Figure 4:
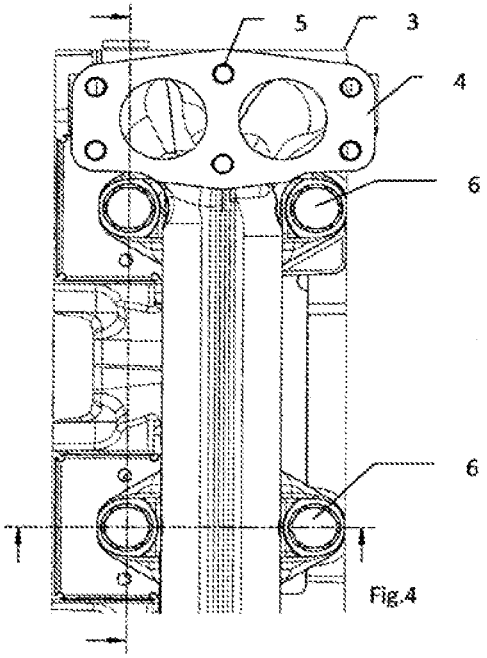
FIG. 4 the embodiment according to FIG. 3, in a top view.

FIG. 4 shows the embodiment according to FIG. 3, in a top view. Depicted here are the exhaust pipe 3, which has the flange 4 with the fastening holes 5, and the fastening screws 6.

Figure 5:
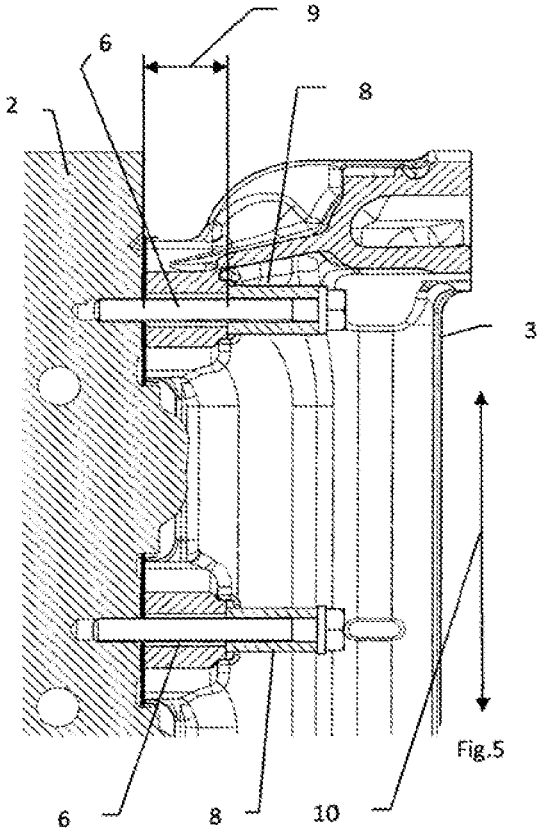
FIG. 5 a side view according to FIG. 3.

FIG. 5 shows a side view according to FIG. 3, with an exhaust pipe 3 that is connected by means of fastening screws 6 and spacer sleeves 8 to the cylinder head 2 of the internal combustion engine. The bending length 9 of the fastening screw 6 is likewise shown. The arrow 10, which is designated with the reference numeral 10, depicts the movement of the exhaust pipe 3 caused by thermal expansion.

Figure 6:
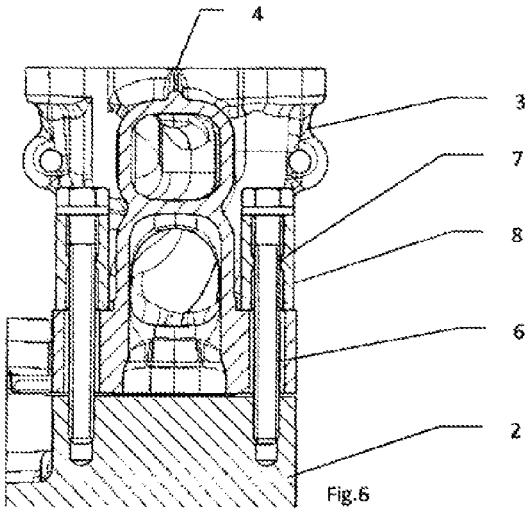
FIG. 6 an embodiment with the centering device shown in FIG. 2.

FIG. 6 shows an installed embodiment of a spacer sleeve 8 with a centering device 7. The exhaust pipe 3 having a flange 4 is screwed to the cylinder head 2 via the spacer sleeve 8 by means of the fastening screw 6.

Figure 7:
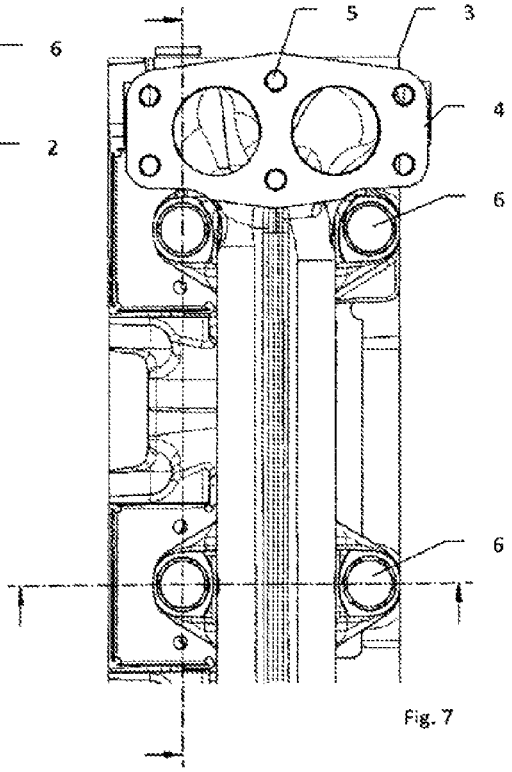
FIG. 7 a top view according to FIG. 6.

FIG. 7 shows the embodiment according to FIG. 6 in a top view. It depicts the exhaust pipe 3, which has the flange 4 with the fastening holes 5 as well as the fastening screws 6.

Figure 8:
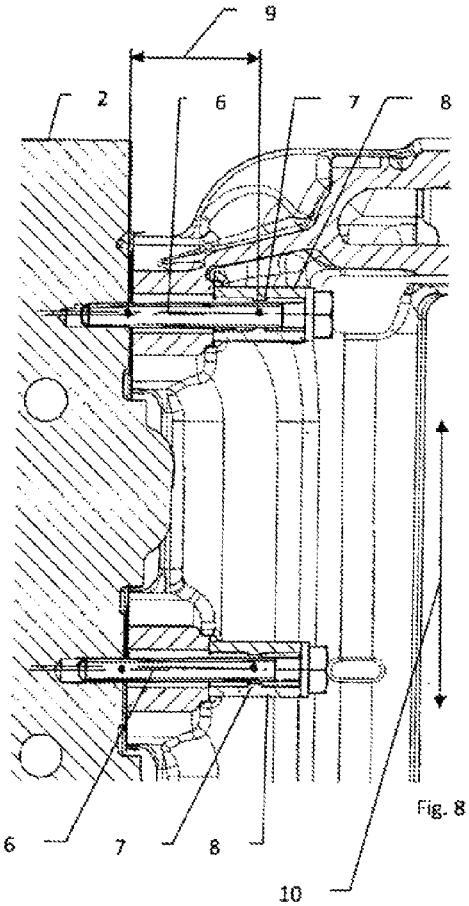
FIG. 8 a side view according to FIG. 6.

FIG. 8 shows a side view according to FIG. 6, depicting the exhaust pipe 3 that is connected to the cylinder head 2 of the internal combustion engine by means of fastening screws 6 and via spacer sleeves 8. The bending length 9 of the fastening screw 6 is likewise shown. The arrow 10, which is designated with the reference numeral 10, depicts the movement of the exhaust pipe 3 caused by thermal expansion.

Figure 11:
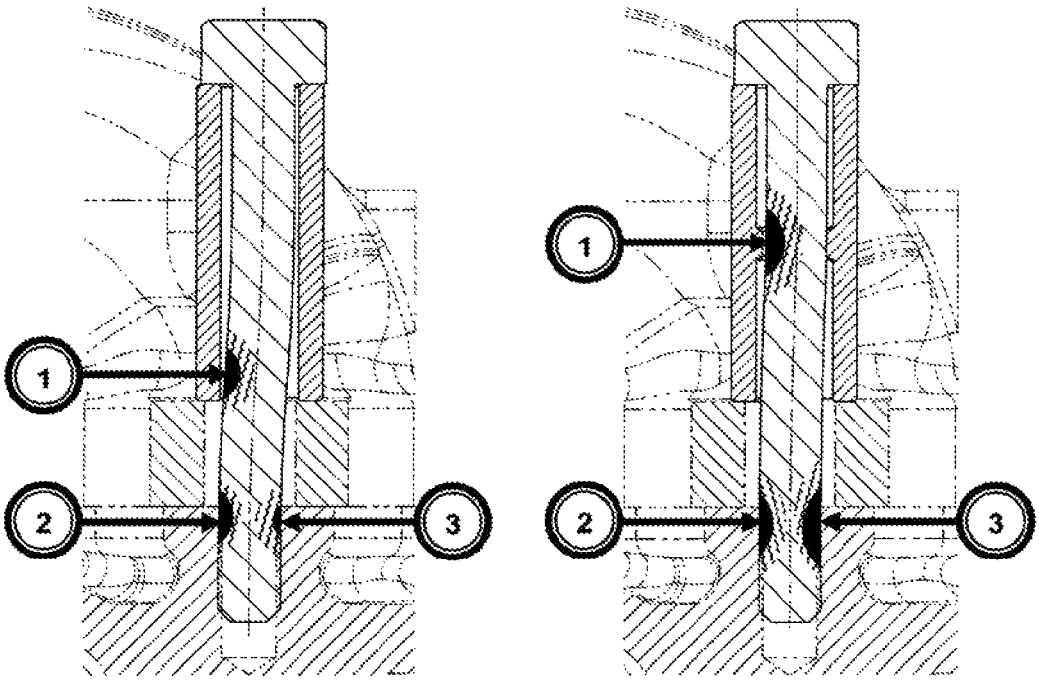
FIG. 11 equivalent stress according to von Mises after being heated up in the third cycle, the state of the art (variant 8) and the embodiment of the invention described above with respect to FIGS. 2 and 6 to 8 (variant 9)
Figure 12:
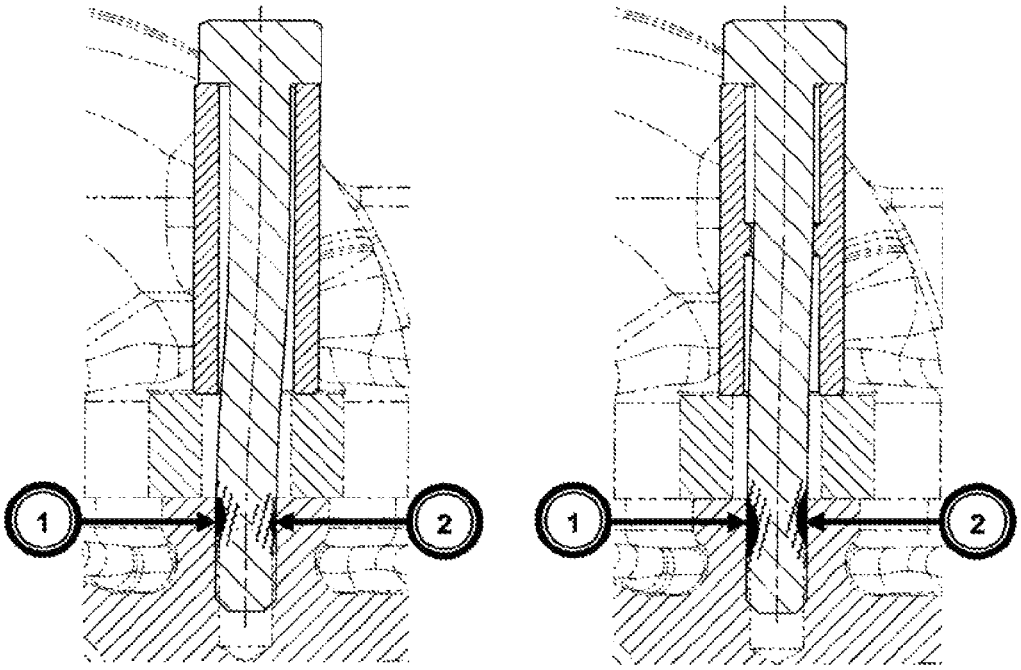
FIG. 12 equivalent stress according to von Mises after being cooled off in the third cycle, the state of the art (variant 8) and the embodiment of the invention described above with respect to FIGS. 2 and 6 to 8 (variant 9).

FIGS. 11 and 12 depict the equivalent stress.

The equivalent stress is a term used in realm of the mechanics of materials and it designates a fictitious uniaxial stress that constitutes the same material strain as a real, multiaxial stress state.

In this manner, the actual three-dimensional load state in the component, consisting of normal stresses and shear stresses in all three dimensions, can be directly compared to the characteristic values stemming from the uniaxial tensile test (material characteristic values, for instance, yield point or ultimate tensile strength). For purposes of completely describing the state of stress in a component, it is usually necessary to indicate the stress tensor (second order tensor). This tensor usually comprises six different stress values (since the shear stresses are pairwise identical). Owing to the transformation of the stress tensor into a preferred coordinate system (the principal axis system), the shear stresses become zero and three preferred (normal) stresses (the principal stresses) equivalently describe the state of stress of the system.

The elements of the vector of the principal stresses or of the stress tensor can now be transferred to a scalar that should satisfy two conditions: on the one hand, it should describe the stress state as comprehensively as possible (equivalence can no longer be achieved here: information losses always occur during the transition from the vector of the principal stresses to the equivalent stress) and, on the other hand, it should depict failure-relevant information in any case.

The calculation rule for the formation of this scalar equivalent stress is referred to as the equivalent stress hypothesis or as the failure rule. Within the scope of a load capacity analysis, the equivalent stress is compared to the permissible stresses. Through the selection of the hypothesis, it implicitly contains the failure mechanism and is therefore a value that expresses the risk to the component under the given strain.

Therefore, the selection of the appertaining equivalent stress hypothesis is always dependent on the strength behavior of the material to be tested as well as on the load case in question (static, vibratory, abrupt).

There are numerous hypotheses for calculating the equivalent stress. In technical mechanics, they are often combined under the term "strength hypotheses". Their use depends on the material behavior and, in part, also on the field of application (for example, if a standard requires the use of a specific hypothesis).

The maximum shear strain energy criterion according to von Mises is most often employed in mechanical engineering and civil engineering.

In accordance with the maximum shear strain energy criterion or maximum shear strain energy criterion according to von Mises, failure of the component occurs when the distortion energy exceeds a limit value (also see distortions and deformation). This criterion is employed for tough materials (e.g. steel) under static and alternating load. The equivalent stress according to von Mises is most often employed in mechanical engineering and civil engineering; the maximum shear strain energy criterion is applicable for most commonly used materials (not excessively brittle) under normal load (alternating, not abrupt). Major fields of application are steel construction and the calculations of shafts, which are subjected to bending as well as torsion. Thus, the maximum shear strain energy criterion is constructed in such a way that an equivalent stress of zero is obtained for virtually hydrostatic states of stress (stresses of equal magnitude in all three dimensions). After all, the plastic flowing of metals is an isochoric process and even extremely hydrostatic pressures do not have any influence on the start of the flow.

Variant 8 corresponds to the state of the art, for instance, according to German patent application DE 10306790 A1 with an increase in the elongation length of the screw and clearance in the exhaust pipe for the movement path. As a rule, the screw head is mounted skewed and it tends to loosen of its own accord.

Variant 9 shows the embodiment of the present invention described above with respect to FIGS. 2 and 6 to 8, which has an additional local clearance for the screw in the sleeve, thus leading to a changed point of introduction of the transverse force. This centering in the sleeve causes less bending or stress of the screw, especially at the tightening site. This results in a flat screw head after the installation. The center shoulder in the sleeve ensures the appropriate installation reliability (poka-yoke). Details are depicted in the subsequent FIGS. 9 to 12. A sleeve with a generally enlarged inner diameter would randomly come to rest against the one side or the other during installation and, due to the fact that the sleeve does not glide on the flange of the exhaust pipe, there would be no improvement in terms of the bending load. This definitively prevents loosening of the screws at the end cylinders.

Figure 9:
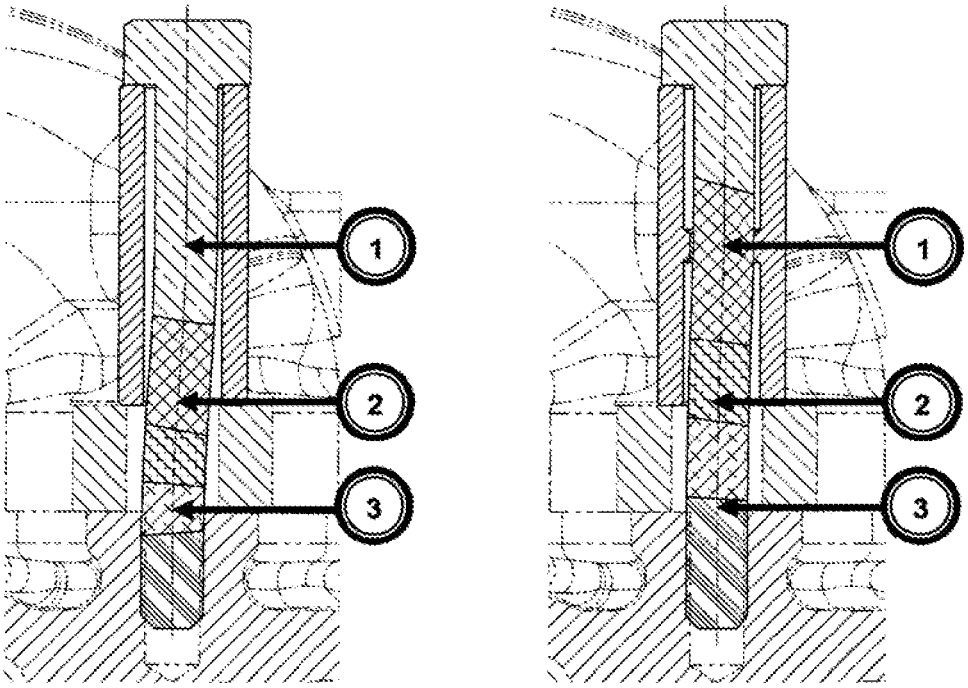
FIG. 9 a view of the deformation of the screws after being heated up, in a comparison between the state of the art (variant 8) and the embodiment of the invention described above with respect to FIGS. 2 and 6 to 8 (variant 9)

FIG. 9 is a view of the deformation of the screws after being heated up, in a comparison. Here, variant 8 shows the state of the art in comparison to the embodiment of the present invention described above with respect to FIGS. 2 and 6 to 8 (variant 9) with the centering device 7, which is also disclosed in FIG. 2 and in FIG. 6. It can be seen here that the bending in the case of the state of the art (variant 8) takes place in the area of the lower sleeve end. In the case of this embodiment of the present invention with the centering device 7, the bending of the screw visibly occurs in the area of the centering device 7.

Figure 10:
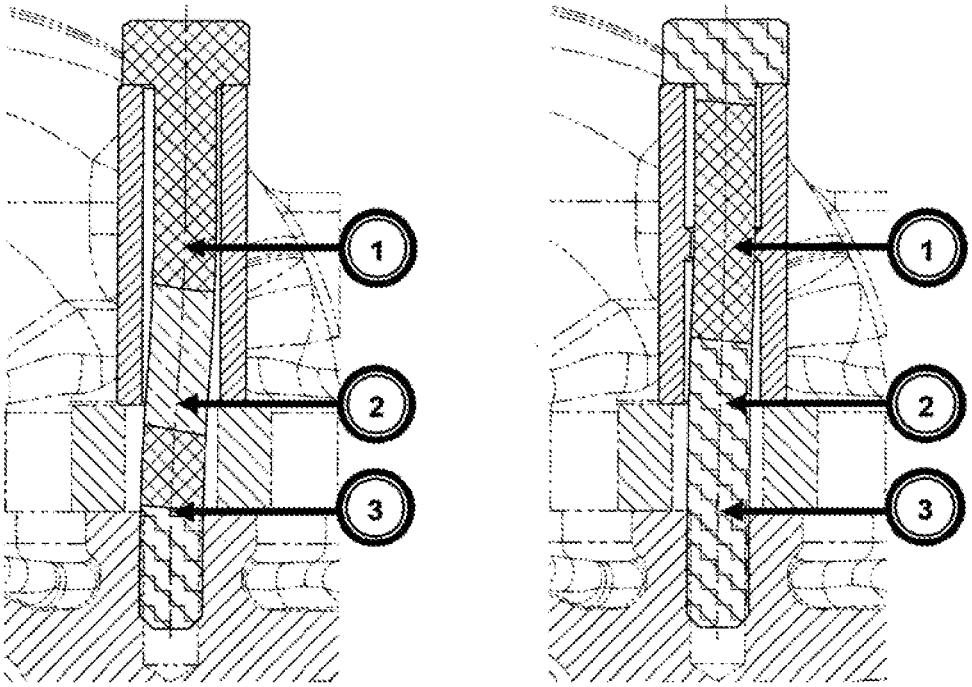
FIG. 10 a view of the deformation of the screws after being cooled off, in a comparison between the state of the art (variant 8) and the embodiment of the invention described above with respect to FIGS. 2 and 6 to 8 (variant 9)

FIG. 10 is a view of the deformation of the screws after being cooled off, in a comparison. The state of the art is shown in variant 8 and the embodiment of the present invention described above with respect to FIGS. 2 and 6 to 8 is depicted in variant 9. In comparison to the state of the art, here, the centering device 7, which is also disclosed in FIG. 2 and in FIG. 6, ensures that the stress is markedly reduced, thus preventing the screw from breaking off. In the case of the state of the art (variant 8), the screw is bent in the area of the lower sleeve end. In the case of this embodiment of the present invention with the centering device 7, the bending of the screw visibly occurs in the area of the centering device 7.

FIG. 11 shows the equivalent stress according to von Mises after being heated up in the third cycle. The state of the art is shown in variant 8 and the embodiment of the present invention described above with respect to FIGS. 2 and 6 to 8 is depicted in variant 9. In comparison to the state of the art, here, the centering device 7, which is also disclosed in FIG. 2 and in FIG. 6, ensures that the stress is markedly reduced, thus preventing the screw from breaking off. In the case of the state of the art (variant 8), the screw is bent in the area of the lower sleeve end. In the case of this embodiment of the present invention with the centering device 7, the bending of the screw visibly occurs in the area of the centering device 7.

FIG. 12 shows the equivalent stress according to von Mises after being cooled off in the third cycle. The state of the art is shown in variant 8 and the embodiment of the present invention described above with respect to FIGS. 2 and 6 to 8 is depicted in variant 9. The centering device 7, which is also disclosed in FIG. 2 and in FIG. 6, ensures that the stress is markedly reduced, thus preventing the screw from breaking off. In the case of the state of the art (variant 8), the screw is bent in the area of the lower sleeve end. In the case of this embodiment of the present invention with the centering device 7, the bending of the screw visibly occurs in the area of the centering device 7. This prevents loosening of the screws from at the end cylinders.

LIST OF REFERENCE NUMERALS

1 internal combustion engine
2 cylinder head of the internal combustion engine
3 exhaust pipe
4 flange
5 flange fastening hole
6 fastening screw

7 centering device
8 spacer sleeve
9 bending length of the fastening screw
10 movement of the exhaust pipe due to heat expansion

What is claimed is:

1. An internal combustion engine comprising:

at least one cylinder head;

at least one exhaust pipe having at least one flange, the flange having at least two flange fastening holes having at least two fastening screws for fastening the exhaust pipe to the cylinder head, the exhaust pipe being connectable to the cylinder head by the fastening screws in such a way that the exhaust pipe is dismantleable from the cylinder head; and at least two spacer sleeves, each of the fastening screws extending axially through a corresponding one of the spacer sleeves and a corresponding one of the flange fastening holes, each spacer sleeve including a spacer hole and a centering device in the spacer hole configured for centering the corresponding fastening screw in the spacer hole, wherein the spacer hole of each spacer sleeve defines an inner circumferential surface, each centering device protruding radially inward from the corresponding inner circumferential surface.

2. The internal combustion engine as recited in claim 1 wherein each spacer sleeve is arranged between a head of the corresponding fastening screw and a corresponding one of the flange fastening holes.

3. A method for operating an internal combustion engine comprising:

providing the internal combustion engine as recited in claim 1; and operating the internal combustion engine.

4. The internal combustion engine as recited in claim 1 wherein the centering device is ring shaped.

5. The internal combustion engine as recited in claim 1 wherein each fastening screw extends through the corresponding spacer hole and then the corresponding flange fastening hole into the cylinder head.

6. An internal combustion engine comprising:

at least one cylinder head;

at least one exhaust pipe having at least one flange, the flange having at least two flange fastening holes having at least two fastening screws for fastening the exhaust pipe to the cylinder head, the exhaust pipe being connectable to the cylinder head by the fastening screws in such a way that the exhaust pipe is dismantleable from the cylinder head; and at least two spacer sleeves, each of the fastening screws extending axially through a corresponding one of the spacer sleeves and a corresponding one of the flange fastening holes, each spacer sleeve including a spacer hole and a centering device in the spacer hole configured for centering the corresponding fastening screw in the spacer hole, wherein each spacer sleeve is arranged between a head of the corresponding fastening screw and a corresponding one of the flange fastening holes, wherein each fastening screw includes a shaft extending from the head into the corresponding spacer hole, each centering device contacting the corresponding shaft.

7. The internal combustion engine as recited in claim 6 wherein the spacer hole of each spacer sleeve defines an inner circumferential surface, each centering device protruding radially inward from the corresponding inner circumferential surface.

8. The internal combustion engine as recited in claim 6 wherein the centering device is ring shaped.

9. The internal combustion engine as recited in claim 6 wherein each fastening screw extends through the corresponding spacer hole and then the corresponding flange fastening hole into the cylinder head.

10. A method for operating an internal combustion engine comprising:

providing the internal combustion engine as recited in claim 6; and operating the internal combustion engine.

* * * * *